United States Patent [19]

Parsons, Jr. et al.

[11] Patent Number: 4,888,826

[45] Date of Patent: Dec. 26, 1989

[54] LEG PROTECTOR

[75] Inventors: Charles Parsons, Jr., Schaumburg, Ill.; Chen C. Fang, Taipei Hsien, Taiwan

[73] Assignee: Parsons Officials Supplies, Inc., Schaumburg, Ill.

[21] Appl. No.: 269,054

[22] Filed: Nov. 9, 1988

[51] Int. Cl.[4] ..... A41D 13/00

[52] U.S. Cl. ..... 2/22

[58] Field of Search ..... 2/16, 22, 24, 62

[56] References Cited

U.S. PATENT DOCUMENTS

| | | | |
|---|---|---|---|
| Re. 32,650 | 4/1988 | Waddell | 2/22 X |
| 1,624,129 | 4/1927 | Barrett | 2/22 |
| 2,982,968 | 5/1961 | Groot | 2/22 |
| 3,135,964 | 6/1964 | Pender | 2/22 |
| 3,735,419 | 5/1973 | Byrd | 2/22 |
| 4,627,108 | 12/1986 | Järvunen | 2/22 |
| 4,633,529 | 1/1987 | Litz | 2/24 X |
| 4,692,946 | 9/1987 | Jurga | 2/22 |

FOREIGN PATENT DOCUMENTS

| | | | |
|---|---|---|---|
| 733239 | 3/1964 | Canada | 2/22 |
| 2322636 | 11/1973 | Fed. Rep. of Germany | 2/22 |
| 541894 | 12/1941 | United Kingdom | 2/22 |

*Primary Examiner*—Werner H. Schroeder
*Assistant Examiner*—Jeanette E. Chapman
*Attorney, Agent, or Firm*—Douglas B. White

[57] ABSTRACT

There is provided a leg protector of the type having a hard shell and underlying padding. The shell is arranged to be detachable and when in place to distribute the impact generally to its periphery pulling the padding in tension around the leg. Additionally, this padding is removeable for replacement or cleaning, while the fasteners are arranged to secure the shell and maintain the padding under tension.

4 Claims, 2 Drawing Sheets

LEG PROTECTOR

BACKGROUND OF THE INVENTION

1. Field of the Invention

This invention relates to improvements in leg protectors, which are used principally in sports such as hockey or baseball.

2. Description of the Prior Art

Leg protectors have typically been represented by a hard shell directly overlying padding permanently attached to it. This would be designed to cover the lower leg and knee area when strapped to the wearer. Leg protectors of all type have remained virtually unchanged throughout the years. Nevertheless there has been a consistant demand to improve the impact absorption as well as the economics of the equipment. Prior devices have been difficult to clean and improvements allowing for the cleaning or replacement of parts have been needed.

SUMMARY OF THE INVENTION

Accordingly, it is a principal objective of the present invention to provide a leg protector with improved impact protection.

It is yet another object to provide such a protector in which the shell part is separable from the pad portion for cleaning or replacement.

Generally there is provided a leg protector of the type having a hard shell and underlying padding. The shell is arranged to be detachable and when in place distributes the impact generally to its periphery pulling the padding in tension around the leg to distribute the force. Additionally, this padding is removable for replacement or cleaning, while the fasteners are arranged to secure the attachment of the padding/shell combination under tension.

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

DESCRIPTION OF THE PREFERRED EMBODIMENT

Figure 1:
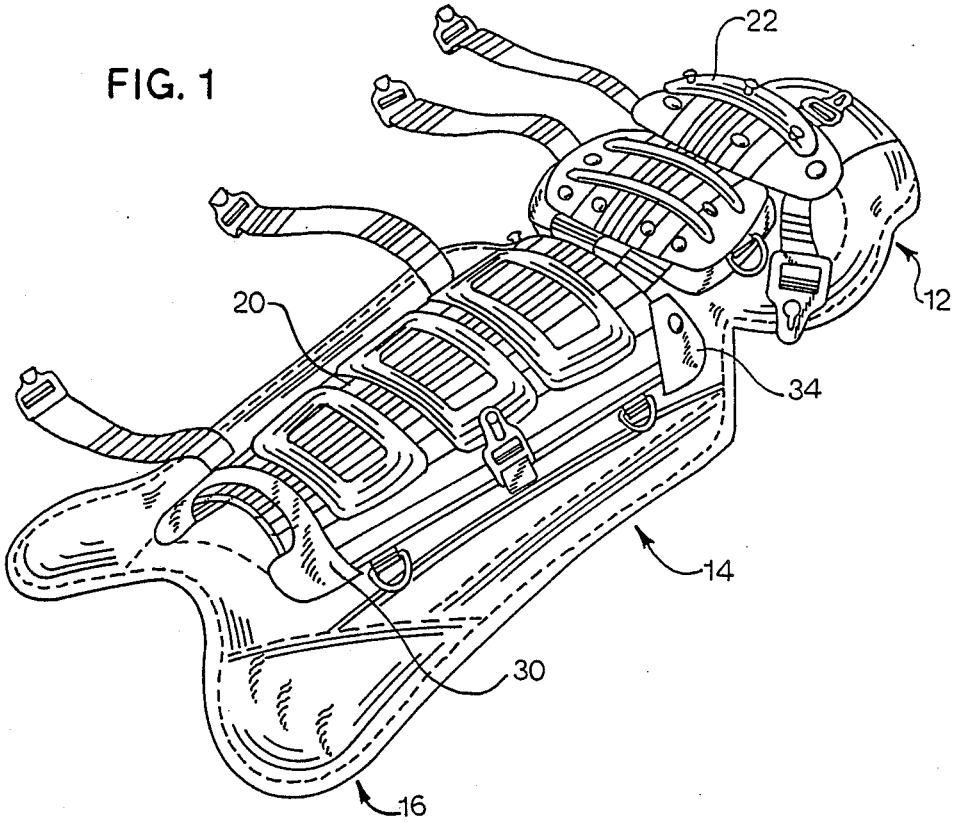
FIG. 1 is a perspective view of the preferred embodiment of the present invention showing the two part shell/padding product and the attaching fastener system.

Turning first to FIG. 1 there is shown a leg protector in accordance with the present invention. This protector features a knee protection section 12, a shin protection section 14, and an ankle protection section 16.

Generally there is provided a hard shell section covering the shin area 20 and a knee area 22. This shell is held releaseably to the padding through a combination of sleeves and releaseable fasteners.

Figure 2:
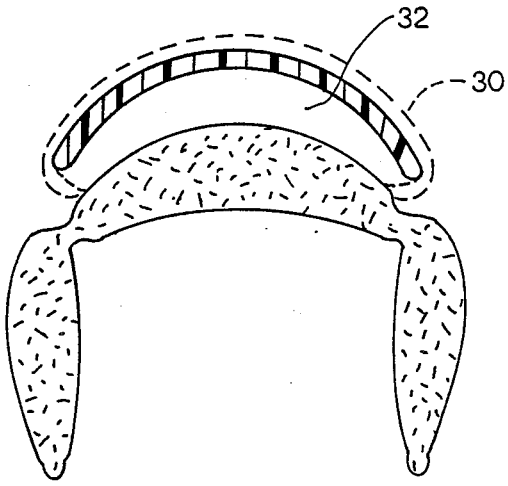
FIG. 2 is a cross sectional view of the leg protector of FIG. 1 showing the relational position of the shell and padding.
Figure 3:
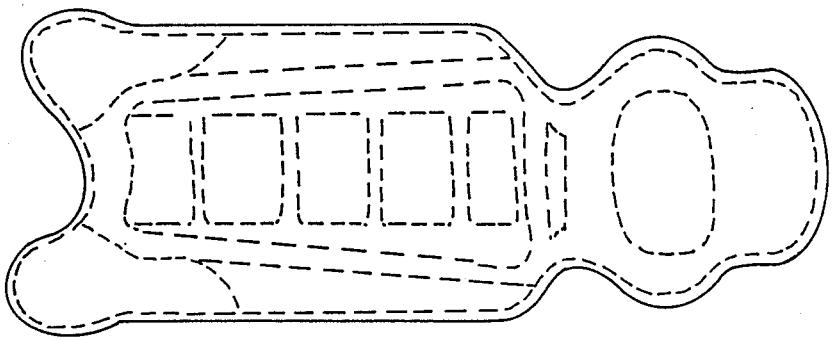
FIG. 3 is a plan view of the product of FIG. 1, viewed from the padding side.
Figure 4:
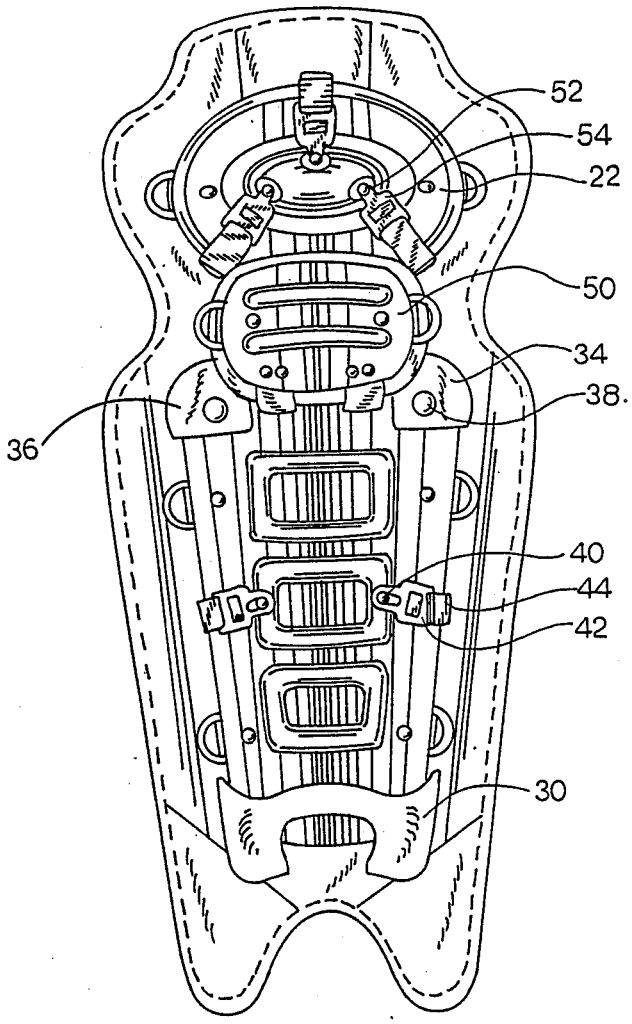
FIG. 4 is a plan view of the preduct of FIG. 1, viewed from the shell side.

Specifically, in the shin area there is provided a lower sleeve 30 (shown in phantom in FIG. 1) into which the shell is fitted whereby the shell is held in an elevated position providing a gap 32 (FIG. 2) between the shell and the padding and thereby distributing impact pressure outwardly. At the upper extremity of the shin portion of the shell, pockets 34 and 36 are positioned to accept the corners of the shell and provide a tight fit. This holds the shell in a slightly elevated position as before described. In a further aspect these pockets are secured to the shell with snap fasteners 38.

Holding the mid section of the shin portion are pins 40 having enlarged heads. These are fitted within slot members 42 and thereby secure the shell to the padding. These slot members are attached to the padding via straps 44 such that they must be stretched under force around the edge of the shell to engage the pins. This helps to place the shell into its bent condition and further secures it along its edges whereby it transmits the impact forces along the periphery.

The shell plate 22 covering the knee area is connected to the shin portion by an intermediate shell piece 50. Similar to the attachment means at the mid portion of the shin plate, there is provided an array of pins 52 having enlarged heads. Slot members 54 are arranged to fit over pins and thereby secure the plate. These slot members are attached to the padding via straps such that the straps are pulled taught around the edge of the plate to hold it in a slightly bent condition to distribute force to the straps around the peripherally.

With the shell connected to the padding in the fashion above-described, direct impact pressure is distributed and not directly transmitted through the padding. Additionally, with the use of a detachable fastening system the padding may be separated from the shell for replacement or cleaning of either part.

From the foregoing description, it will be apparent that modifications can be made to the apparatus and method for using same without departing from the teaching of the present invention. Accordingly the scope of the invention is only to be limited as necessitated by the accompanying claims.

What is claimed is:

1. An improved leg protector of the type having a hard shell portion and a padding portion arranged to be strapped to the leg of the wearer, wherein the improvement comprises releaseable fastener means arranged on the periphery of the shell to engage with releaseable fastener means on the periphery of the padded portion, and said releaseable fastener means on the periphery of the padded portion including pockets for holding the corners of the shell.

2. The improved leg protector of the type having a hard shell portion and a padding portion arranged to be strapped to the leg of claim 1 wherein said fasteners include slot members affixed to the padding and pin members affixed to the shell having enlarged heads thereon for holding the pin member within the slot member when inserted therein.

3. An improved leg protector of the type having a hard shell portion and a padding portion arranged to be strapped to the leg of the wearer, wherein the improvement comprises releaseable fastener means arranged on the periphery of the shell to engage with releaseable fastener means on the periphery of the padded portion, and said releaseable fastener means on the periphery of the padded portion including pockets for holding the corners of the shell, and where in the shell member is formed to secure the padding in tension around the leg of the wearer and provide a gap between the shell and padding.

4. The improved leg protector of the type having a hard shell portion and a padding portion arranged to be strapped to the leg of claim 3 wherein said fastener include slot members affixed to the padding and pin members affixed to the shell having enlarged heads thereon for holding said pin members within said slot members when inserted therein.

* * * * *